US007045697B2

(12) United States Patent
Covello et al.

(10) Patent No.: US 7,045,697 B2
(45) Date of Patent: May 16, 2006

(54) ELECTRONIC TAMBOURINE

(76) Inventors: Gina Covello, 33 College Hills Dr., Farmingville, NY (US) 11738; H. Edward Vega, 33 College Hills Dr., Farmingville, NY (US) 11738

( * ) Notice: Subject to any disclaimer, the term of this patent is extended or adjusted under 35 U.S.C. 154(b) by 0 days.

(21) Appl. No.: 10/962,220

(22) Filed: Oct. 8, 2004

(65) Prior Publication Data

US 2006/0075877 A1 Apr. 13, 2006

(51) Int. Cl.
*G10D 13/02* (2006.01)

(52) U.S. Cl. ..... 84/418

(58) Field of Classification Search ..... 84/406, 84/418; D17/22; 446/330, 418, 421, 203
See application file for complete search history.

(56) References Cited

U.S. PATENT DOCUMENTS 4,230,015 A 10/1980 Taninbaum
D306,608 S 3/1990 Wang
D336,488 S 6/1993 Grey
5,293,000 A * 3/1994 Adinolfi ..... 84/730
5,323,678 A * 6/1994 Yould ..... 84/418
5,377,575 A 1/1995 Huth, III
5,915,289 A 6/1999 Hart
6,239,343 B1 5/2001 Hoshino

* cited by examiner

*Primary Examiner*—Kimberly Lockett
(74) *Attorney, Agent, or Firm*—Richard L. Miller

(57) ABSTRACT

An improved tambourine of the type having a frame being arcuate-shaped and including a center of gravity, a pair of rims, and a grasping portion disposed at or near the center of gravity of the frame so as to allow comfortable holding for long periods of time, and a plurality of jingle members being affixed to the frame. The improvement includes an electronic sound pick-up apparatus. The electronic sound pick-up apparatus is either an amplifier pick-up or a midi pick-up. The amplifier pick-up is disposed in the frame, opposite the grasping portion, and the midi pick-up is disposed on the pair of rims of the frame, to a side of the grasping portion. The improvement further includes soft pad beading covering the pair of rims of the frame.

13 Claims, 2 Drawing Sheets

ELECTRONIC TAMBOURINE

CROSS REFERENCE TO RELATED APPLICATIONS

The instant application contains subject matter disclosed in applicant's Disclosure Document No. 544314 filed on Dec. 29, 2003, and as such, it is respectfully requested in a separate paper attached herewith that this Disclosure Document be relied upon and remain a permanent part of the file history during the prosecution of the instant application and during any subsequent action thereof.

BACKGROUND OF THE INVENTION

1. Field of the Invention

The present invention relates to a tambourine, and more particularly, the present invention relates to an electronic tambourine.

2. Description of the Prior Art

Numerous innovations for tambourines have been provided in the prior art that will be described. Even though these innovations may be suitable for the specific individual purposes to which they address, however, they differ from the present invention.

A FIRST EXAMPLE, U.S. Pat. No. 4,230,015 to Taninbaum teaches an improved tambourine which includes an arcuate frame having a plurality of jingle members affixed to the frame, the frame including a grasping portion disposed at or near the center of gravity of the rim such that the tambourine may be comfortably held for long periods of time. The handle may include a padded portion and may be disposed close to the geometrical center of the rim, as desired.

A SECOND EXAMPLE, U.S. Pat. No. D306,608 to Wang teaches the ornamental design for a tambourine or a similar article.

A THIRD EXAMPLE, U.S. Pat. No. D336,488 to Grey teaches the ornamental design for a tambourine.

A FOURTH EXAMPLE, U.S. Pat. No. 5,377,575 to Huth, III teaches a hand-held percussion instrument capable of generating a variety of different sounds upon demand. These sounds including the typical sound of cymbals coming from a tambourine, the sound of a drum which is stretched over an open side of a tambourine, the sound of a maraca which is generated from a multitude of pellets contained within a hollow chamber inside the handle, this sound being adjusted by selectively covering or uncovering openings in the handle, and the sound of a lone cymbal set located at the end of the handle some distance from the tambourine.

A FIFTH EXAMPLE, U.S. Pat. No. 5,915,289 to Hart teaches an electronic cymbal apparatus which significantly shortens the vibratory response of the prolonged resonating acoustical tone produced by the percussive impact on an electrically conductive striking surface thereby enabling the pick-up of such shortened vibratory response by a transducer, such as, without limitation, a piezoelectric transducer. The electronic cymbal apparatus utilizes conventional cymbal substrates, such as, without limitation, in the form of a broad-brim hat wherein the use of conventional cymbal substrates allows the musician to employ conventional acoustical "striking" techniques while playing the electronic cymbal apparatus.

A SIXTH EXAMPLE, U.S. Pat. No. 6,239,343 to Hoshino teaches a cymbal holder including: a support member having an installation hole; a holding rod installed in the hole, the rod having a tool holding lower region above the installation hole and having a screw threaded upper region; a tubular, cymbal receiving tool with a tubular part disposed around the holding rod and having a radially projecting receiving part intermediate its length; a cymbal on the tubular part of the tool; a lower elastic member between the receiving part on the tubular part of the tool and the cymbal; an upper elastic member above the cymbal and held by a nut tightened on the screw thread of the rod; the cymbal receiving part is intermediate the length of the tubular part of the cymbal receiving tool so that the cymbal receiving tool is adapted to be installed with either of its side portions above the receiving part being up or down, so that the tool can be inverted as required.

It is apparent that numerous innovations for tambourines have been provided in the prior art that are adapted to be used. Furthermore, even though these innovations may be suitable for the specific individual purposes to which they address, however, they would not be suitable for the purposes of the present invention as heretofore described.

SUMMARY OF THE INVENTION

ACCORDINGLY, AN OBJECT of the present invention is to provide an electronic tambourine that avoids the disadvantages of the prior art.

ANOTHER OBJECT of the present invention is to provide an electronic tambourine that is simple to use.

BRIEFLY STATED, STILL ANOTHER OBJECT of the present invention is to provide an improved tambourine of the type having a frame being arcuate-shaped and including a center of gravity, a pair of rims, and a grasping portion disposed at or near the center of gravity of the frame so as to allow comfortable holding for long periods of time, and a plurality of jingle members being affixed to the frame. The improvement includes an electronic sound pick-up apparatus. The electronic sound pick-up apparatus is either an amplifier pick-up or a midi pick-up. The amplifier pick-up is disposed in the frame, opposite the grasping portion, and the midi pick-up is disposed on the pair of rims of the frame, to a side of the grasping portion. The improvement further includes soft pad beading covering the pair of rims of the frame.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures of the drawing are briefly described as follows.

LIST OF REFERENCE NUMERALS UTILIZED IN THE DRAWING

Figure 1:
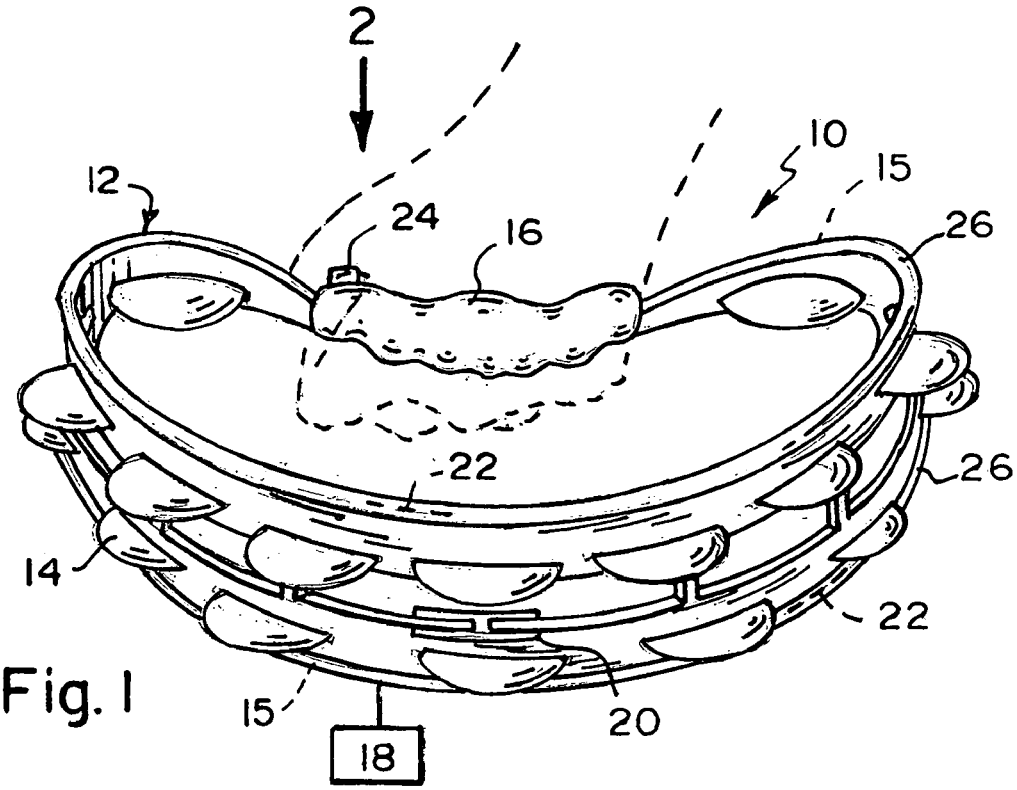
FIG. 1 is a diagrammatic perspective view of the electronic tambourine of the present invention in use.

10 electronic tambourine of present invention
12 frame
14 plurality of jingle members
15 pair of rims of frame 12
16 grasping portion of frame 12
18 electronic sound pick-up apparatus
20 amplifier pick-up of electronic sound pick-up apparatus 18
22 midi pick-up of electronic sound pick-up apparatus 18
24 amplifier/midi socket of electronic sound pick-up apparatus 18
26 soft pad beading

DETAILED DESCRIPTION OF THE PREFERRED EMBODIMENT

Figure 2:
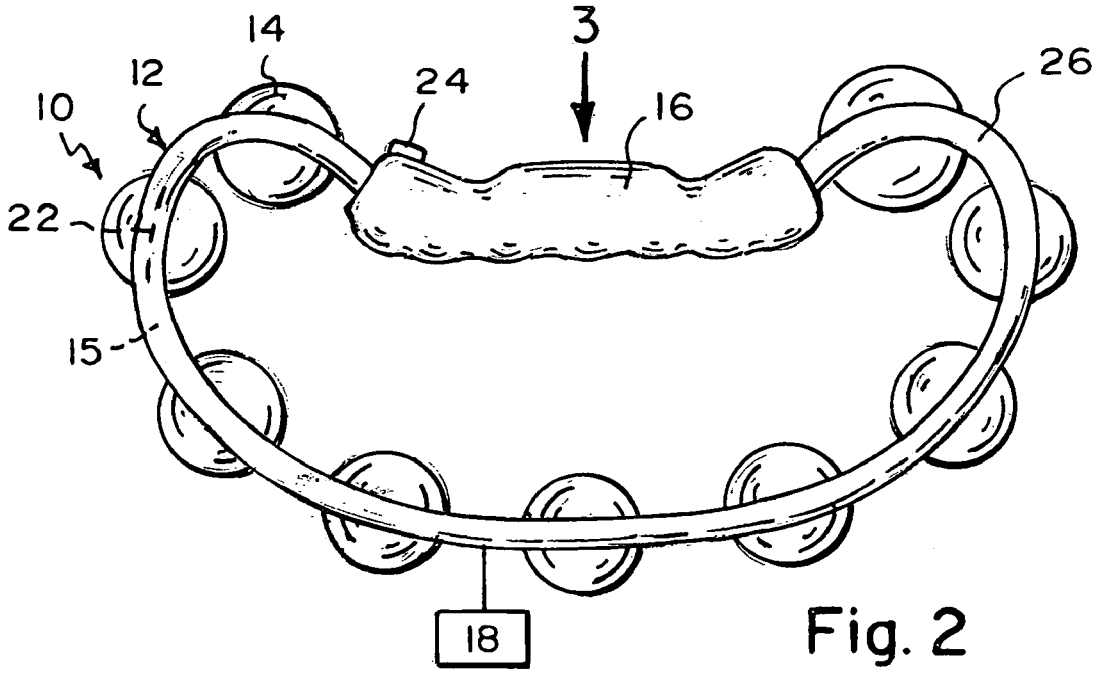
FIG. 2 is a diagrammatic top plan view taken of the electronic tambourine of the present invention taken generally in the direction of ARROW 2 in FIG. 1.
Figure 3:
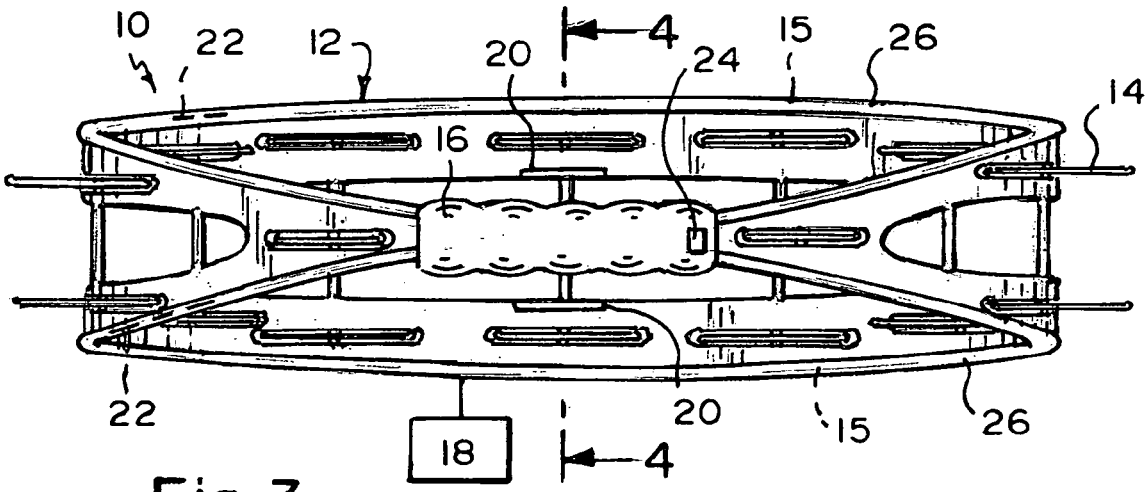
FIG. 3 is a diagrammatic rear elevational view taken generally in the direction of ARROW 3 in FIG. 2.
Figure 4:
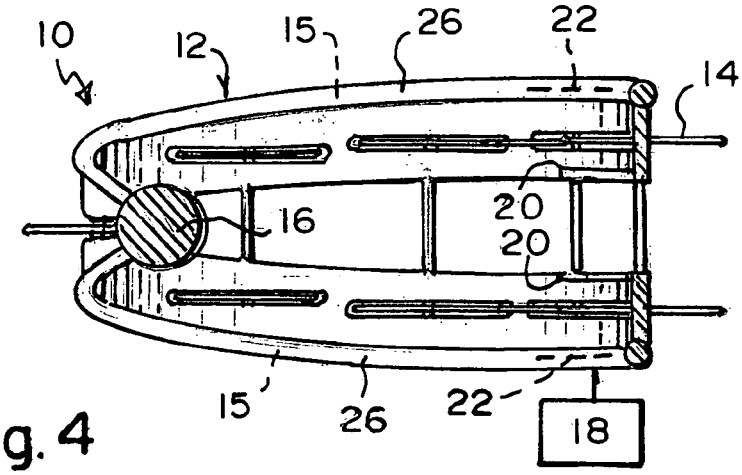
FIG. 4 is a diagrammatic cross sectional view taken along LINE 4—4 in FIG. 3.

Referring now to the figures, in which like numerals indicate like parts, and particularly to FIGS. 1–4, which are, respectively, a diagrammatic perspective view of the electronic tambourine of the present invention in use, a diagrammatic top plan view taken of the electronic tambourine of the present invention taken generally in the direction of ARROW 2 in FIG. 1, a diagrammatic rear elevational view taken generally in the direction of ARROW 3 in FIG. 2, and a diagrammatic cross sectional view taken along LINE 4—4 in FIG. 3, the electronic tambourine of the present invention is shown generally at 10.

The electronic tambourine 10 comprises a frame 12 being arcuate-shaped and including a center of gravity, a pair of rims 15, and a grasping portion 16 disposed at or near the center of gravity of the frame 12 so as to allow comfortable holding for long periods of time, and a plurality of jingle members 14 being affixed to the frame 12.

The electronic tambourine 10 comprises an electronic sound pick-up apparatus 18. The electronic sound pick-up apparatus 18 is one of an amplifier pick-up 20 and a midi pick-up 22.

The amplifier pick-up 20 of the electronic sound pick-up apparatus 18 is disposed in the frame 12, opposite the grasping portion 16 of the frame 12.

The midi pick-up 22 of the electronic sound pick-up apparatus 18 is disposed on the pair of rims 15 of the frame 12, to a side of the grasping portion 16 of the frame 12.

The electronic sound pick-up apparatus 18 further comprises an amplifier/midi socket 24. The amplifier/midi socket 24 of the electronic sound pick-up apparatus 18 is disposed at one end of the grasping portion 16 of the frame 12.

The amplifier/midi socket 24 of the electronic sound pick-up apparatus 18 electrically communicates with one of the amplifier pick-up 20 of the electronic sound pick-up apparatus 18 and the midi pick-up 22 of the electronic sound pick-up apparatus 18, depending upon which is present.

The electronic tambourine 10 further comprises soft pad beading 26. The soft pad beading 26 covers the pair of rims 15 of the frame 12, and thereby covers the midi pick-up 22 of the electronic sound pick-up apparatus 18 when present by virtue of the midi pick-up 22 of the electronic sound pick-up apparatus 18 being disposed on the pair of rims 15 of the frame 12.

It will be understood that each of the elements described above, or two or more together, may also find a useful application in other types of constructions differing from the types described above.

While the invention has been illustrated and described as embodied in an electronic tambourine, however, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. An improved tambourine of the type having a frame being arcuate-shaped and including a center of gravity, a pair of rims, and a grasping portion disposed at or near the center of gravity of the frame so as to allow comfortable holding for long periods of time, and a plurality of jingle members being affixed to the frame, said improvement comprising an electronic sound pick-up apparatus, wherein said improvement further comprises said electronic sound pick-up apparatus being an amplifier pick-up, wherein said improvement further comprises said electronic sound pick-up apparatus further comprising an amplifier socket.

2. The improved tambourine as defined in claim 1, wherein said improvement further comprises said amplifier pick-up of said electronic sound pick-up apparatus being disposed in the frame, opposite the grasping portion of the frame.

3. The improved tambourine as defined in claim 1, wherein said improvement further comprises said amplifier socket of said electronic sound pick-up apparatus being disposed at one end of the grasping portion of the frame.

4. The improved tambourine as defined in claim 1, wherein said improvement further comprises said amplifier socket of said electronic sound pick-up apparatus electrically communicating with said amplifier pick-up of said electronic sound pick-up apparatus.

5. The improved tambourine as defined in claim 1, wherein said improvement further comprises soft pad beading.

6. The improved tambourine as defined in claim 5, wherein said improvement further comprises said soft pad beading covering the pair of rims of the frame.

7. An improved tambourine of the type having a frame being arcuate-shaped and including a center of gravity, a pair of rims, and a grasping portion disposed at or near the center of gravity of the frame so as to allow comfortable holding for long periods of time, and a plurality of jingle members being affixed to the frame, said improvement comprising an electronic sound pick-up apparatus, wherein said improvement further comprises said electronic sound pick-up apparatus being a midi pick-up, wherein said improvement further comprises said electronic sound pick-up apparatus further comprising a midi socket.

8. The improved tambourine as defined in claim 7, wherein said improvement further comprises said midi pick-up of said electronic sound pick-up apparatus being disposed on the pair of rims of the frame.

9. The improved tambourine as defined in claim 8, wherein said improvement further comprises said midi pick-up of said electronic sound pick-up apparatus being disposed to a side of the grasping portion of the frame.

10. The improved tambourine as defined in claim 8, wherein said improvement further comprises soft pad beading.

11. The improved tambourine as defined in claim 10, wherein said improvement further comprises said soft pad beading covering the pair of rims of the frame and thereby covering said midi pick-up of said electronic sound pick-up apparatus by virtue of said midi pick-up of said electronic sound pick-up apparatus being disposed on the pair of rims of the frame.

12. The improved tambourine as defined in claim 7, wherein said improvement further comprises said midi socket of said electronic sound pick-up apparatus being disposed at one end of said grasping portion of the frame.

13. The improved tambourine as defined in claim 7, wherein said improvement further comprises said midi socket of said electronic sound pick-up apparatus electrically communicating with said midi pick-up of said electronic sound pick-up apparatus.

* * * * *